US006523216B1

(12) United States Patent
Nelson

(10) Patent No.: US 6,523,216 B1
(45) Date of Patent: Feb. 25, 2003

(54) SCRUB BRUSH COVER DEVICE

(76) Inventor: Michael T. Nelson, 6805 Garden Hwy., Sacramento, CA (US) 95837

( * ) Notice: Subject to any disclaimer, the term of this patent is extended or adjusted under 35 U.S.C. 154(b) by 0 days.

(21) Appl. No.: 09/929,433

(22) Filed: Aug. 13, 2001

(51) Int. Cl.[7] ..... A46B 17/04; A47L 13/44
(52) U.S. Cl. ..... 15/247; 15/228
(58) Field of Search ..... 15/227, 228, 247

(56) References Cited

U.S. PATENT DOCUMENTS

| | | | | |
|---|---|---|---|---|
| 897,286 | A | | 9/1908 | Haskell |
| 968,924 | A | * | 8/1910 | Enge |
| 1,138,305 | A | * | 5/1915 | Miller |
| 2,140,578 | A | | 12/1938 | Goodlue |
| 2,301,586 | A | * | 11/1942 | Rubin |
| 2,526,119 | A | | 10/1950 | Cravis |
| 2,816,313 | A | * | 12/1957 | Beck et al. |
| 3,012,264 | A | | 12/1961 | Nash |
| 3,428,987 | A | * | 2/1969 | Loston |
| 3,846,862 | A | * | 11/1974 | Botting |
| 4,114,223 | A | * | 9/1978 | Buchanan |
| 4,384,382 | A | | 5/1983 | Diamant |
| 4,670,930 | A | * | 6/1987 | Lu |
| 4,945,599 | A | | 8/1990 | Flynn |
| 5,280,664 | A | * | 1/1994 | Lin |
| 6,098,238 | A | * | 8/2000 | Stern |
| 6,115,873 | A | * | 9/2000 | Dunkley |

FOREIGN PATENT DOCUMENTS

| | | | |
|---|---|---|---|
| GB | 2255900 | * | 11/1992 |

* cited by examiner

*Primary Examiner*—Terrence R. Till
(74) *Attorney, Agent, or Firm*—Theodore J. Bielen, Jr.

(57) ABSTRACT

A cover device for a scrub brush utilizing a pouch having a pair of sides that form an open chamber. First side contacts the bristles of the brush when the same is placed within the pouch. The first side also includes a plurality of ridges and depressions, the latter of which is capable of accommodating bristles from the brush to attenuate movement of the same. The second layer of water absorbent material possesses a soft friction surface to aid in the dispersal and cleaning process when the brush is held within the pouch.

10 Claims, 2 Drawing Sheets

SCRUB BRUSH COVER DEVICE

BACKGROUND OF THE INVENTION

The present invention relates to a novel and useful cover device for a scrub brush.

Scrub brushes have been used in many instances to clean surfaces. In certain cases, scrub brushes inadequately contact the surface which is to be cleaned due to spacing between the bristles of the brush, the stiffness of the bristles, and the like. Also, the soap and water solution which is employed in conjunction with the brush is poorly held to the brush during the cleaning procedure.

In the past, many covers have been devised for cleaning purposes. For example, U.S. Pat. Nos. 3,012,264 and 4,945,599 show cleaning cloths that are dimensioned to fit over sponge mops.

U.S. Pat. No. 2,526,119 describes a fountain-washing device in which a sponge is enclosed by a bag or sack to aid in cleaning fountains.

U.S. Pat. No. 4,384,382 shows a disposable toothbrush cover in which permits one to brush ones teeth and then is trashed by suitable means.

U.S. Pat. No. 2,140,578 shows a scouring device in which a brush in enclosed by a mesh member of metallic configuration, that abrades a surface.

U.S. Pat. No. 897,286 shows a cleaning and polishing apparatus where a brush is enclosed by a cover having a two-part lamination. The outer lamination is soft and permits cleaning of surfaces.

A cover device for a scrub brush which is capable of cleaning surfaces in a superior manner would be a notable advance in the maintenance arts.

BRIEF SUMMARY OF THE INVENTION

In accordance of the present invention a novel and useful cover device for a scrub brush is herein provided.

The cover device of the present invention utilizes a pouch which is formed with a first side and a second side attached to the first side. The first and second sides form an open chamber for at least partially enclosing a scrub brush. The first side is capable of contacting and engaging a plurality of bristles of the scrub brush, and includes a series of ridges and depressions for this purpose. The pouch first and second layers may be porous to water, and, preferably, porous to water containing detergent or soap. The second layer includes a soft friction surface and is capable of holding water.

Means is also included in the present invention for supporting the pouch to the scrub brush. Such supporting means may take the form of a flap attached to the pouch and means for removably connecting the flap to the pouch. Such means for removably connecting the flap to the pouch may include one or more fasteners such as snaps, hooks and eyes, hook and pile fasteners, and the like. The flap may also include a slit to accommodate a handle for the scrub brush.

The pouch first side may further comprise a third layer of material which overlies and abrasively reinforces the first layer of material. Such third layer would conform to the plurality of ridges and depressions of the first layer to permit confinement of the bristles of the scrub brush to the depressions of the same. Thus, the cover device of the present invention is adaptable to scrub brushes of various sizes, shapes, and types.

It may be apparent that a novel and useful cover device for a scrub brush has been herein above described.

It is therefore an object of the present invention to provide a cover device for a scrub brush which exhibits superior cleaning characteristics on surfaces of all types.

Another object of the present invention is to provide a cover device for a scrub brush which is capable of holding water for use with a scrub brush when cleaning objects.

Another object of the present invention is to provide a cover device for a scrub brush which accommodates the bristles of a scrub brush and employs the force of the same to clean a surface using a soft surface rubbing layer.

Yet another object of the present invention is provide a cover for a scrub brush which is easy to install on a conventional scrub brush structure and may be easily removed for replacement of the same.

A further object of the present invention is to provide a cover for a scrub brush which is durable and extends the use of a scrub brush of conventional structure.

The invention possesses other objects and advantages especially as concerns particular characteristics and features thereof which will become apparent as the specification continues.

For a better understanding of the invention reference is made to the following detailed description of the preferred embodiments thereof which should be taken in conjunction with the prior described drawings.

DETAILED DESCRIPTION OF THE PREFERRED EMBODIMENTS OF THE INVENTION

Various aspects of the present invention will evolve from the following detailed description of the preferred embodiments thereof which should be referenced to the hereinabove-delineated drawings.

Figure 2:
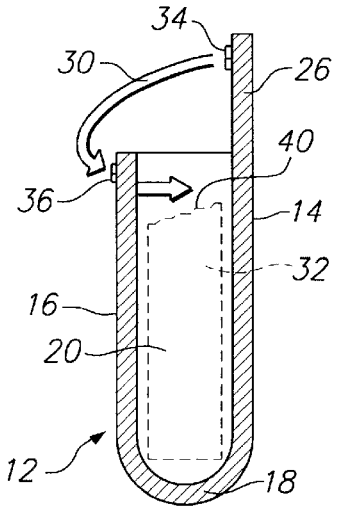
FIG. 2 is a sectional view taken along line 2—2 of FIG. 1.
Figure 4:
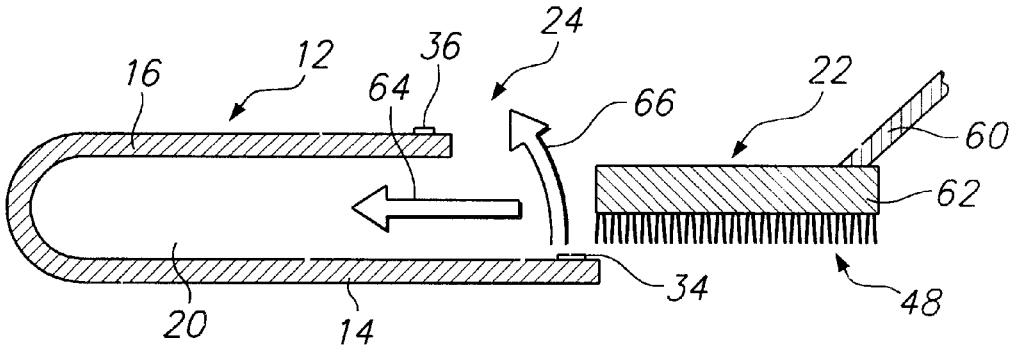
FIG. 4 is a sectional view showing the direction between a conventional scrub brush and the cover device of the present invention.

The invention as a whole is shown in the drawings by reference character 10. Cover device 10 includes as one of its elements a pouch 12. Pouch 12 possesses a first side 14 and a second side 16. First and second sides 14 and 16 connect to one another or are contiguous to one another as depicted in the drawings. With respect to FIG. 2, it may be observed that curved or bent portion 18 forms the interface between first side 14 and second side 16. First and second sides, as depicted in FIG. 2, form a chamber 20. Chamber 20 is intended to enclose a scrub brush 22, FIG. 4 and partially in phantom on FIG. 2, which will be discussed in greater detail as the application continues hereinafter.

Device 10 possesses means 24 for supporting pouch 12 to scrub brush 22. Means 22 may include a flap 26 attached to pouch 12. Means 28 removably connects flap 26 to pouch 12. More specifically, means 28 allows free end 30 of flap 26 to connect to second side 16 of pouch 12. Although any types of fasteners may be employed in this regard, such as hook and pile fasteners, magnets, buttons, hooks and eyes, a plurality of two-part snaps 32 are depicted in the drawings as achieving this result. With reference to FIG. 2, it may be observed that exemplar snap members 34 and 36 mate to enclose chamber 20 within pouch 12 and, scrub brush 22 therewithin. Directional arrows 38 and 40 indicate the movement of flap 26 and first side 14 relative to second side 16 of pouch 12 when enclosing scrub brush 22.

Figure 3:
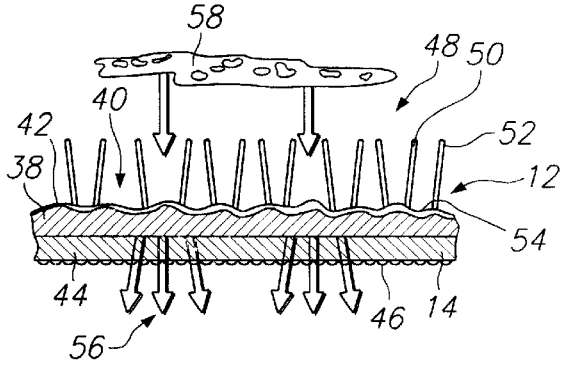
FIG. 3 is an enlarged sectional view of the first side of the pouch of the cover device of the present invention interacting with a plurality of bristles from a scrub brush.

Turning to FIG. 3, it may be observed that a detail of the structure of pouch 12 is depicted. First side 14 of pouch 12 possesses a first layer 38 having a plurality of ridges and depressions 40. A protective layer 42 may cover layer 38 without diminishing the accessibility plurality of ridges and depressions 40. A second layer 44 is composed of a soft water absorbing substance and includes a soft friction surface 46 to allow cleaning of objects. Most importantly, it should be noted that plurality of bristles 48 presses into the depressions of first layer 38. For example, bristles, such as bristles 50 and 52 contact and engage depression 54. Such contact and engagement of plurality of bristles 48 concentrates the force of bristles 48 to side 14 and, ultimately, to friction surface 46. Directional arrows 56 indicate the exertion of such force and the general spreading of the same along frictional surface 46 when device 10 is in use. Although FIG. 3 depicts side 14 as having a peculiar structure, it may be observed that such multi-layer structure of side 14 may extend to side 16 through bend portion, 18 for the sake of ease of construction of device 10. Body of water 58 indicates that pouch 12 and, in particular side 14, may be formed of porous material to allow water associated with scrub brush 22 to exit through side 14 when device 10 is employed.

Figure 1:
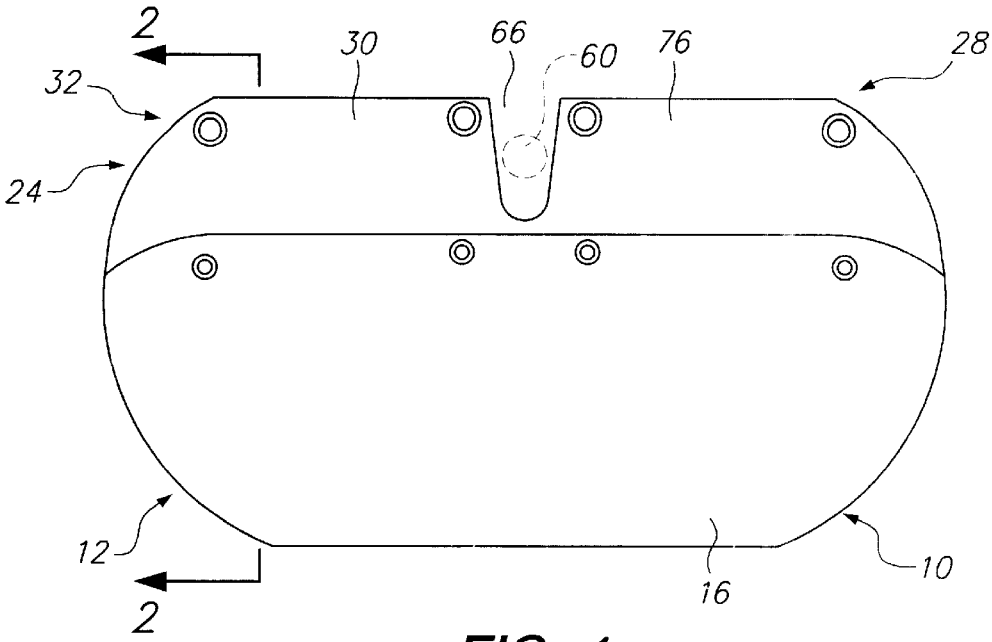
FIG. 1 is a front elevational view of the cover device of the present invention.
Figure 5:
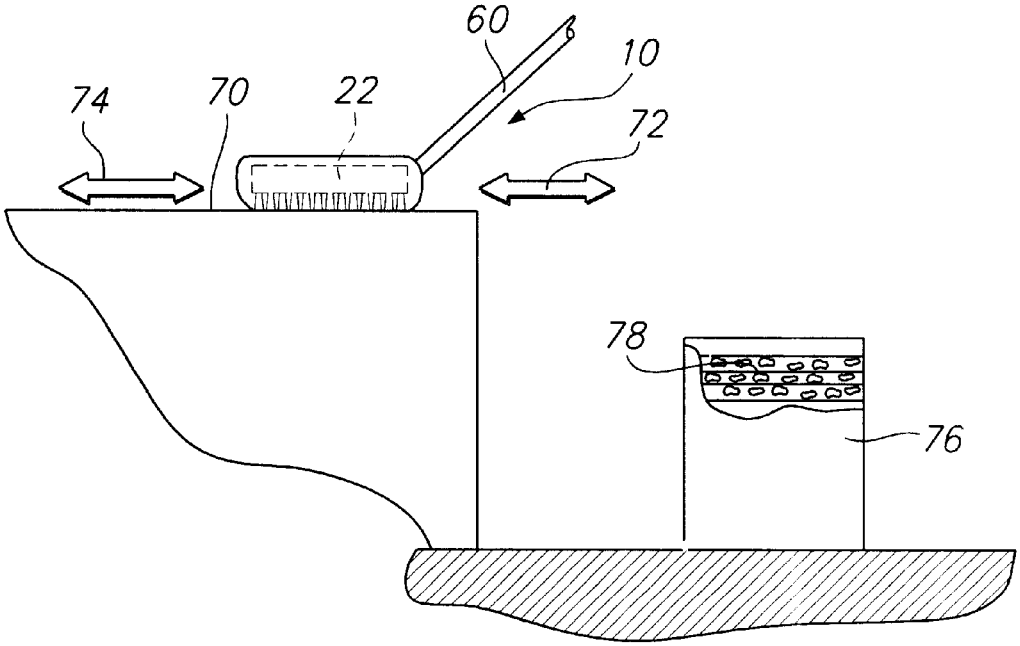
FIG. 5 is a side elevational view of the cover device of the present invention in use on a conventional scrub brush and a cleaning solution container for use therewith.

In operation, scrub brush 20 having a handle 60 is employed in the present invention. Scrub brush 22 possesses a bristle support 62 and a plurality of bristles 48, such as those shown in FIG. 3. Scrub brush 22 is passed into chamber 20 of device 10 such that plurality of bristles 48 engage the depressions of first layer 38 and lie against first side 14 of pouch 12. Directional arrow 64 illustrates the general direction of scrub brush 22 into chamber 20 of pouch 12, while directional arrow 66 depicts the closing of pouch 12 over scrub brush 22 and the supporting of the same by means 44 exemplified by snap members 34 and 36. Handle 60 is intended to fit within slit 68 of device 10, FIG. 1. After device 10 has covered scrub brush 22, it may be employed to clean a surface 70, FIG. 5, by moving scrub brush 22 and cover device 10 back and forth according to directional arrows 72 and 74. A combination of scrub brush 22 and device 10 may be dipped into container 76 having a cleaning solution 78 such as soap and water. Absorbent layer 44 of first side 14 of pouch 12 will hold aqueous solutions while second layer 38 of first side 14 of pouch 26 will confine plurality of bristles 48 of scrub brush 12 into a plurality of depressions to maximize the outward force of the same and greatly accelerate the cleaning action of device 10 and scrub brush 22. Soft surface 46 of layer 44 of first side 14 of pouch 20 easily cleans a soiled surface, such as surface 70, thereby.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A cover device for a scrub brush having a plurality of bristles and a bristle support, comprising:

a. a pouch, said pouch formed with a first side and a second side attached to said first side, said first and second sides forming an open chamber for at least partially enclosing a scrub brush, said first side capable of contacting and engaging a plurality of bristles of the scrub brush, said pouch first side being constructed of a material having a first layer having a surface possessing a plurality of ridges and depressions, each of said depressions being capable of accommodating at least one bristle, and a second layer connected to said first layer, said second layer possessing a soft friction surface; capable of holding water; and b. means for supporting said pouch to said scrub brush.

2. The device of claim 1 in which said means for supporting said pouch to said scrub brush comprises a flap attached to said pouch, and means for removably connecting said flap to said pouch.

3. The device of claim 2 in which said means for removable connecting said flap to said pouch comprises at least one fastener.

4. The device of claim 3 in which said fastener comprises a snap.

5. The device of claim 2 which further comprises a slit in said flap.

6. The device of claim 1 in which said pouch first side further comprises a third layer of material overlying and abrasively reinforcing said first layer of material without eliminating said plurality of ridges and depressions thereof.

7. The device of claim 6 in which said means for supporting said pouch to said scrub brush comprises a flap attached to said pouch, and means for removably connecting said flap to said pouch.

8. The device of claim 7 in which said means for removable connecting said flap to said pouch comprises at least one fastener.

9. The device of claim 8 in which said fastener comprises a snap.

10. The device of claim 7 which further comprises a slit in said flap.

* * * * *